US005875763A

United States Patent [19]

Mottier et al.

[11] Patent Number: 5,875,763

[45] Date of Patent: Mar. 2, 1999

[54] INTERNAL COMBUSTION ENGINE WITH TEMPERATURE DEPENDENT TIMING OF SPARK EVENT

[75] Inventors: Bradley D. Mottier; J. Norman MacLeod, both of Jacksonville; Dean Mechlowitz, Ponte Vedra Beach, all of Fla.

[73] Assignee: Unison Industries Limited Partnership, Jacksonville, Fla.

[21] Appl. No.: 802,612

[22] Filed: Feb. 19, 1997

Related U.S. Application Data

[63] Continuation-in-part of Ser. No. 694,950, Aug. 9, 1996, abandoned, which is a continuation of Ser. No. 281,492, Jul. 27, 1994, Pat. No. 5,544,633, which is a continuation-in-part of Ser. No. 263,458, Jun. 22, 1994, abandoned.

[51] Int. Cl.[6] ..... F02P 5/15; F02P 11/02

[52] U.S. Cl. ..... 123/417; 123/418; 123/421

[58] Field of Search ..... 123/149 C, 415, 123/416, 417, 421, 424, 425

[56] References Cited

U.S. PATENT DOCUMENTS

| | | | |
|---|---|---|---|
| 957,270 | 5/1910 | Studnicka et al. | 123/640 |
| 1,015,089 | 1/1912 | Seeley | 123/640 |
| 1,074,416 | 9/1913 | Dinkins et al. | 123/149 R |
| 1,074,724 | 10/1913 | LePontois | 315/119 |
| 1,221,200 | 4/1917 | McClenathen | 123/641 |
| 2,285,107 | 3/1942 | Bohli | 123/640 X |
| 2,371,016 | 3/1945 | Alvino | 123/640 |
| 2,481,890 | 9/1949 | Toews | 123/310 |
| 2,522,921 | 9/1950 | Barkeij | 123/309 |
| 4,069,801 | 1/1978 | Stevens | 123/640 X |
| 4,180,031 | 12/1979 | Muranaka et al. | 123/407 |
| 4,351,281 | 9/1982 | Geiger et al. | 123/418 X |
| 4,399,774 | 8/1983 | Tsutsumi | 123/421 X |
| 4,493,307 | 1/1985 | Trinh et al. | 123/630 |
| 4,606,315 | 8/1986 | Tobinaga et al. | 123/417 |
| 4,611,570 | 9/1986 | Nash | 123/601 |
| 4,624,234 | 11/1986 | Koketsu et al. | 123/602 |
| 4,716,873 | 1/1988 | Takaba et al. | 123/416 X |
| 4,817,577 | 4/1989 | Dykstra | 123/651 |
| 4,858,585 | 8/1989 | Remmers | 123/602 |
| 5,320,075 | 6/1994 | Regueiro | 123/310 |
| 5,331,935 | 7/1994 | Daino | 123/640 X |
| 5,544,633 | 8/1996 | Mottier et al. | 123/310 |

OTHER PUBLICATIONS

"Starting Vibrator Assemblies", Bendix Engine Products Division, Aug., 1978.

"The Aircraft Magneto", Bendix Engine Products Division, vol. 7, (1954).

*Primary Examiner*—Tony M. Argenbright

*Attorney, Agent, or Firm*—Leydig, Voit & Mayer, Ltd.

[57] ABSTRACT

A magneto-based, variable-timing ignition system for an internal combustion engine is provided that maintains at least one operating parameter of the engine within a predetermined limit. An electronic controller sets the timing of spark events based on engine performance criteria such as the temperature of the engine's cylinder head, speed and manifold pressure. If the values of one of these parameters, such as engine temperature, extends beyond a predetermine limit, the electronic controller retards the advance timing of the spark events to draw back within the limit the values of the parameter. The timing of spark events is ordinarily under electronic control. If the electronic control fails, the system provides spark events whose timing are fixed and synchronized to the mechanical rotation of the crankshaft of the engine.

44 Claims, 9 Drawing Sheets

CYLINDER HEAD TEMPERATURE SENSOR
MANIFOLD PRESSURE SENSOR
80
FROM SPEED/POSITION SENSORS 79
81
BATTERY
77
CONTROLLER
TO CURRENT REG. & SW.
TO MODE SW.
2nd MAG-NETO 13
105
CURRENT REGULATOR & SW.
PLUGS 17
PISTONS 18
#1
#2
#3
#4
#5
#6
#7
#8
#9
MODE SW.
83
25
23
24
22
107
109
47
73
53
33
27
63
95
50
79
29
31
SPEED/POS-ITION SENSOR
TO CONTROLLER 77
MAGNETO 11

FIG. 3A
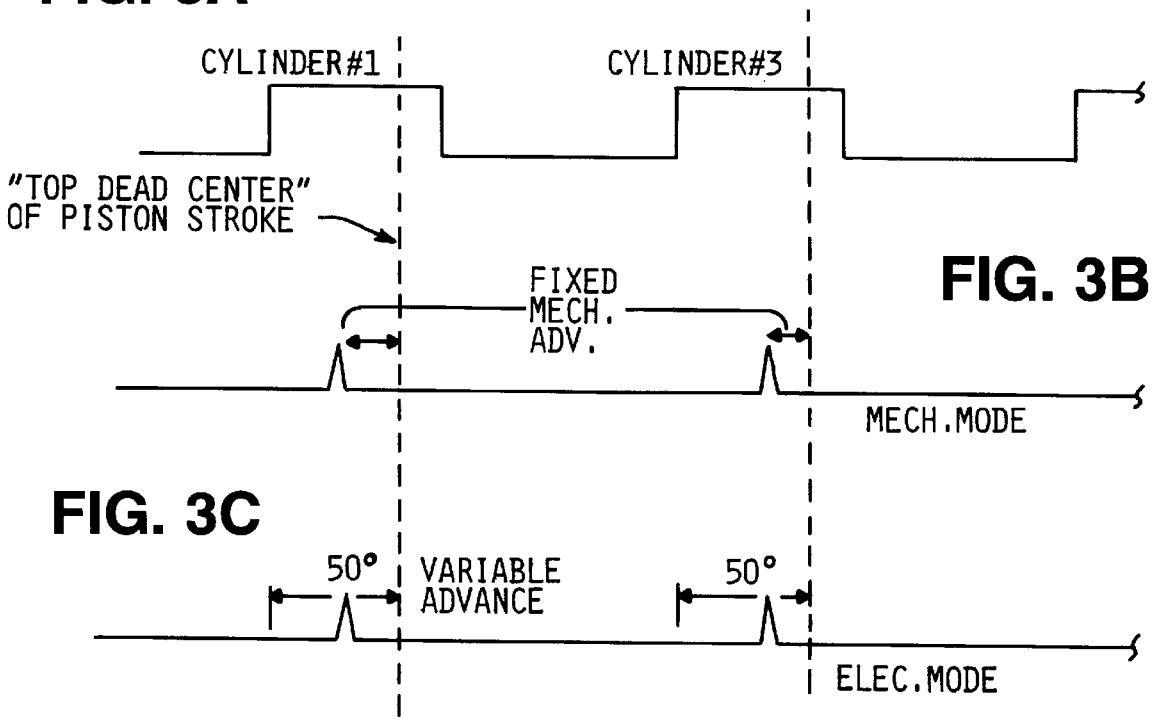
FIG. 3B
FIG. 3C
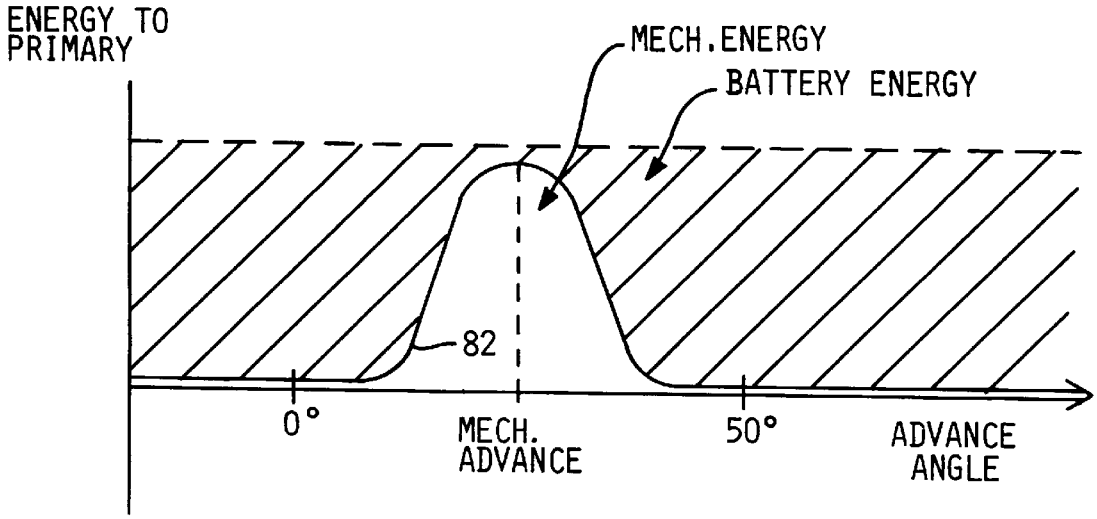
FIG. 4

INTERNAL COMBUSTION ENGINE WITH TEMPERATURE DEPENDENT TIMING OF SPARK EVENT

This application is a continuation-in-part of U.S. patent application Ser. No. 08/694,950, (now abandoned), filed Aug. 9, 1996, which is a continuation of U.S. patent application Ser. No. 08/281,492 (now U.S. Pat. No. 5,544,633, issued Aug. 13, 1996) filed Jul. 27, 1994, which in turn is a continuation-in-part of U.S. patent application Ser. No. 08/263,458, filed Jun. 22, 1994 (now abandoned).

TECHNICAL FIELD

The invention relates to ignition systems for internal combustion engines and, more particularly, to ignition systems employing magnetos.

BACKGROUND OF THE INVENTION

Magneto-based ignition systems are well known and are often used with internal combustion engines in applications where batteries are not practical. Magnetos are robust devices that are typically highly reliable. As such, magneto-based ignition systems have been historically used with internal combustion engines for aircraft applications. In a typical magneto-based ignition system for an aircraft internal combustion engine, redundant ignition systems are employed for safety purposes. Also, with safety in mind, the magneto-based ignition systems for aircraft are typically mechanically timed to ensure highly reliable operation. In this connection, it is not uncommon for small aircraft to experience malfunctions of their electrical systems. Because of the obvious need to ensure high reliability of the ignition systems for internal combustion engines in aircraft applications, such ignition systems have historically avoided electronic ignition control mechanisms for advancing and retarding spark timing, even though such electrical control devices are commonly used in automotive applications.

Because magneto-based ignition systems in aircraft applications employ mechanical linkage to time the spark events, the timing of the spark event for each piston is at a fixed advance with respect to the "top-dead-center" (TDC) position of the reciprocating piston. The advance is typically selected for optimum performance under take-off conditions. Unfortunately, during different parts of a flight, the engine is operating in different conditions. Therefore, the advance and total energy of a spark event that provides the most efficient combustion and energy conversion varies during the flight. In the past, the small aircraft industry has sacrificed engine performance in order to ensure safety by maintaining the fixed mechanical advance of the spark event for all engine operating conditions. As a result of the fixed mechanical advance of the magneto-based ignition systems for small aircraft, the engines operate at less than optimum fuel economy and exhaust more pollutants.

There have been attempts to provide variable ignition timing of spark events in magneto-based ignition systems. For example, U.S. Pat. No. 4,624,234 to Koketsu et al. describes an electronic circuit for controlling the timing of the spark event and a mechanism for defaulting to a mechanical timing when the regulated voltage supply for the electronic circuit is inadequately regulated. In this system, however, the sole source of energy for the spark event is the rotating magnet of the magneto. Unfortunately, the power curve of the magneto is mechanically fixed and the mechanical advance for the ignition is usually selected to occur at the peak of the magneto's power curve. The power curve of the magneto is such that the energy output from the rotating magnet to the primary coil of the magneto is a bell-shaped curve, which is typically centered at the mechanical advance provided by the breaker points of the magneto. Therefore, changing the timing of the spark event relative to the mechanical setting results in a reduction in the energy of the spark event.

The problems exemplified by the foregoing patent to Koketsu et al. were overcome by a dual-mode ignition system described in U.S. Pat. No. 5,544,633 to Mottier et al., which is hereby incorporated by reference. The ignition system of the '633 patent operates in first and second modes. The first mode employs magneto and battery energy sources to electronically control the timing and total energy of each spark event. Alternatively, the second mode is a fail-safe mode of operation that employs only the magneto energy source to provide fixed mechanical timing of the spark event in case of a failure in the electrical system of the engine. In both modes of operation, the conventional primary and secondary coils of the magneto are used to generate and discharge energy to the spark plugs of the engine.

In the first mode of operation, engine conditions such as speed and manifold pressure are used to either advance or retard the timing of the spark event relative to a fixed mechanical setting. If a failure in the electrical system occurs, the ignition system defaults to the fixed mechanical setting of the second mode, which is provided by the mechanical interconnections of the engine and the ignition system.

When the ignition system is in the first mode, the primary coil of the magneto receives its input energy from both the rotating magnet of the magneto and the battery of the electrical system of the engine. When the timing of the spark event is either advanced or retarded with respect to the mechanical setting as set by the magneto, the battery of the engine's electrical system supplements the decreasing power to the primary coil from the rotating magnet of the magneto. In contrast, the adjustable timing provided by the ignition system of the Koketsu et al. patent uses only the rotating magnet of the magneto as a source of power, resulting in the timing of the spark event quickly moving off the peak of the magneto's power curve such that the energy provided to the spark plug is seriously compromised.

In keeping with the '633 patent, the timing of spark events is advanced or retarded so as to maximize engine efficiency in accordance with changing engine conditions as measured by parameters such as speed and manifold pressure. However, operation at maximum efficiency may cause operating parameters of the engine to exceed those that are specified by agencies or organizations that qualify the engine for aircraft applications—i.e., the Federal Aviation Administration (FAA) of the United States Federal Government. For example, internal combustion engines for aircraft often require customized installation configurations to ensure that cylinder head temperatures remain within limits acceptable to the qualifying agency. When an ignition system with variable ignition timing of the type described in the '633 patent is incorporated into an internal combustion engine, the cylinder head temperature of the engine may exceed its maximum limit when the ignition timing is advanced much beyond the fixed mechanical setting.

SUMMARY OF THE INVENTION

It is a general aim of the invention to provide an ignition system for an internal combustion engine that enhances engine performance while maintaining values of operating parameters within a range mandated by agencies that qualify the engine for aircraft applications.

It is a more specific object of the invention to provide an ignition system that enhances the output power of an internal combustion engine while maintaining the temperature of the engine within a range of temperatures mandated by the qualifying agency.

It is a more specific object of the invention to provide an ignition system that enhances the efficiency of an internal combustion engine while maintaining the temperature of the engine within a range of temperatures that enhance the life of engine components.

It is a more detailed object of the invention to provide an ignition system for an internal combustion engine in an aircraft that achieves both the foregoing objectives and the advantages of the ignition system described in the '633 patent.

Other objects and advantages of the invention will be apparent from the following detailed description and the accompanying drawings.

The foregoing and other objectives are achieved by a magneto-based variable ignition timing system for an internal combustion engine in which an advance of the timing is incrementally retarded from an optimal setting in order to maintain one or more operating parameters within a desired range of values. Preferably, the range of vales are dynamically determined in response to the operating status of the engine. In an aircraft application, the system might first set a high "climb" value for the maximum temperature of the engine for the initial phase of the flight and a lower "cruise" value for the maximum temperature of the engine after the initial phase of the flight has been completed. The "climb" value is maintained until the engine's temperature exceeds the "cruise" value, at which time, the system selects the "cruise" value as the maximum temperature for the engine, but only after another limit has been exceeded, for example, a predetermined time period has elapsed. This other limit can be an event detected by one or more sensors for detecting an operating condition of the engine or the aircraft. For example, the event may be the aircraft exceeding a threshold altitude as detected by an altimeter.

By delaying the switch to the lower "cruise" value by a predetermined time period, the system allows the engine to operate at the higher "climb" temperature value during the initial phase of the flight where maximum engine power is beneficial. By providing two limit values for engine temperature, the engine is allowed to operate at a higher temperature for a limited time, i.e., during take-off and then operate at a lower temperature for the balance of the flight. If the temperature of the engine exceeds the higher "climb" value before the system selects the lower "cruise" value and the predetermined time period has elapsed, the ignition timing advance is incrementally trimmed until the engine temperatures are below the "climb" value. If and when the engine temperature exceeds the lower "cruise" value, a timer is activated to measure the predetermined time period. After the time period has elapsed, the system switches to the lower "cruise" value, and further adjustments to the ignition timing advance are made to maintain operating temperatures within the range of this lower value. If the engine temperatures do not exceed the lower "cruise" value during the initial phase of the flight and the timer is never activated, the system remains in the higher "climb" value.

Because the switching to the lower limit may result in a further trimming of the advance of the timing and a loss of power for a fixed throttle position, the system maintains the higher "climb" limit for no less than a minimum time period to ensure that any power loss at a fixed throttle position does not happen during take off. In the illustrated embodiment, this minimum time period is realized by the predetermined time period measured from a time after the temperature of the engine first exceeds the lower "cruise" limit as explained above. The engine does not need a magneto-based ignition system to benefit from the invention, although a magneto based system that has a dual mode operation as described in the '633 patent is preferable for aircraft application. Examples of ignition systems for internal combustion engines that may benefit from this invention include the following: a distributorless (DIS) ignition system in conjunction with one dual-mode magneto; a DIS ignition system in conjunction with one conventional magneto; a distributed battery ignition system in conjunction with one dual-mode or conventional magneto; a single or dual DIS system; and, a single or dual distributed system.

The temperature control function can involve maintaining a desired engine temperature or limiting the temperature to high and/or low limits. Increasing the ignition timing angle at a low power setting during a descent, for example, will heat the cylinder head to a higher temperature than if the ignition timing were at a low angle, thus reducing the deleterious effects of shock cooling the cylinder heads and extending the useful service life of the components.

While the invention will be described in some detail with reference to a preferred embodiment, it will be understood that it is not intended to limit the invention to such detail. On the contrary, it is intended to cover all alternatives, modifications, and equivalents that fall within the spirit and scope of the invention as defined by the appended claims.

BRIEF DESCRIPTION OF THE DRAWINGS

FIGS. 3A–3C are exemplary timing diagrams illustrating the timing of a distributor (FIG. 3A), the fixed mechanical advance of a spark event provided by the conventional points of the magneto-based ignition system operating in a mechanical or "default" mode (FIG. 3B) and a variable advance/retard of the spark event provided by the controller of the ignition system operating in an electronic mode (FIG. 3C);

FIG. 4 is an exemplary graph illustrating the contributions made by mechanical and battery sources to the power delivered to a primary coil of the ignition system for various timing angles of the spark event;

DETAILED DESCRIPTION OF THE ILLUSTRATED EMBODIMENT

Figure 1:
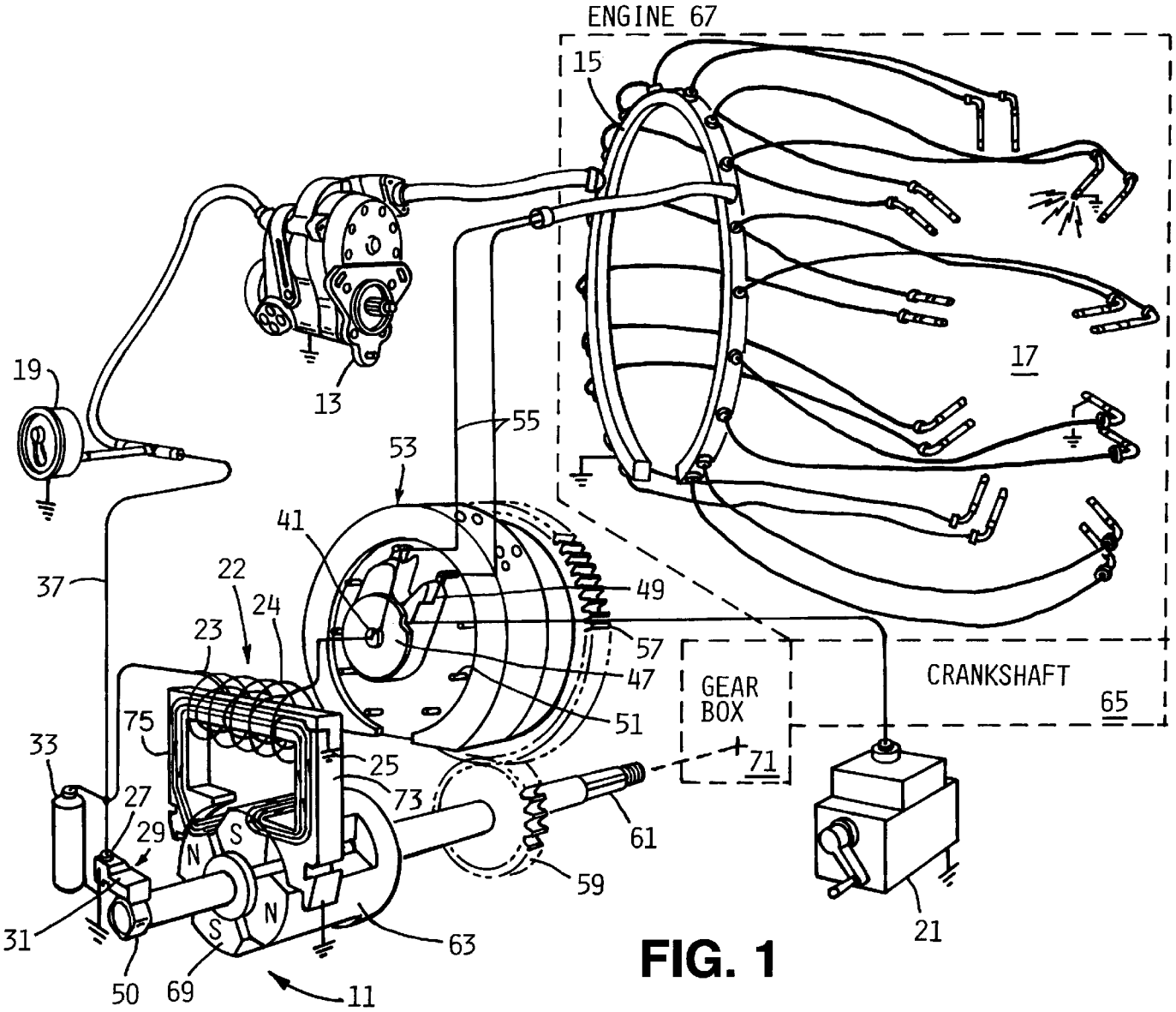
FIG. 1 is a pictorial illustration of a magneto-based ignition system also illustrated in U.S. Pat. No. 5,544,633, which is an example of an ignition system that may incorporate the present invention.

FIG. 1 illustrates a complete high-tension ignition system incorporating the invention and consisting of two magnetos 11 and 13, radio shield harness 15, spark plugs 17, an ignition switch 19, and a booster magneto 21. One magneto 13 is illustrated completely assembled and the other 11 is in skeleton form showing electrical and magnetic circuits. The two magnetos 11 and 13 are identical. Because the structure and function of these magnetos 11 and 13 are described in detail in U.S. Pat. No. 5,544,633, which has been incorporated herein by reference, that description is not repeated. The invention is described in detail hereinafter only in connection with magneto 11 because the invention operates identically with respect to magneto 13.

Figure 2:
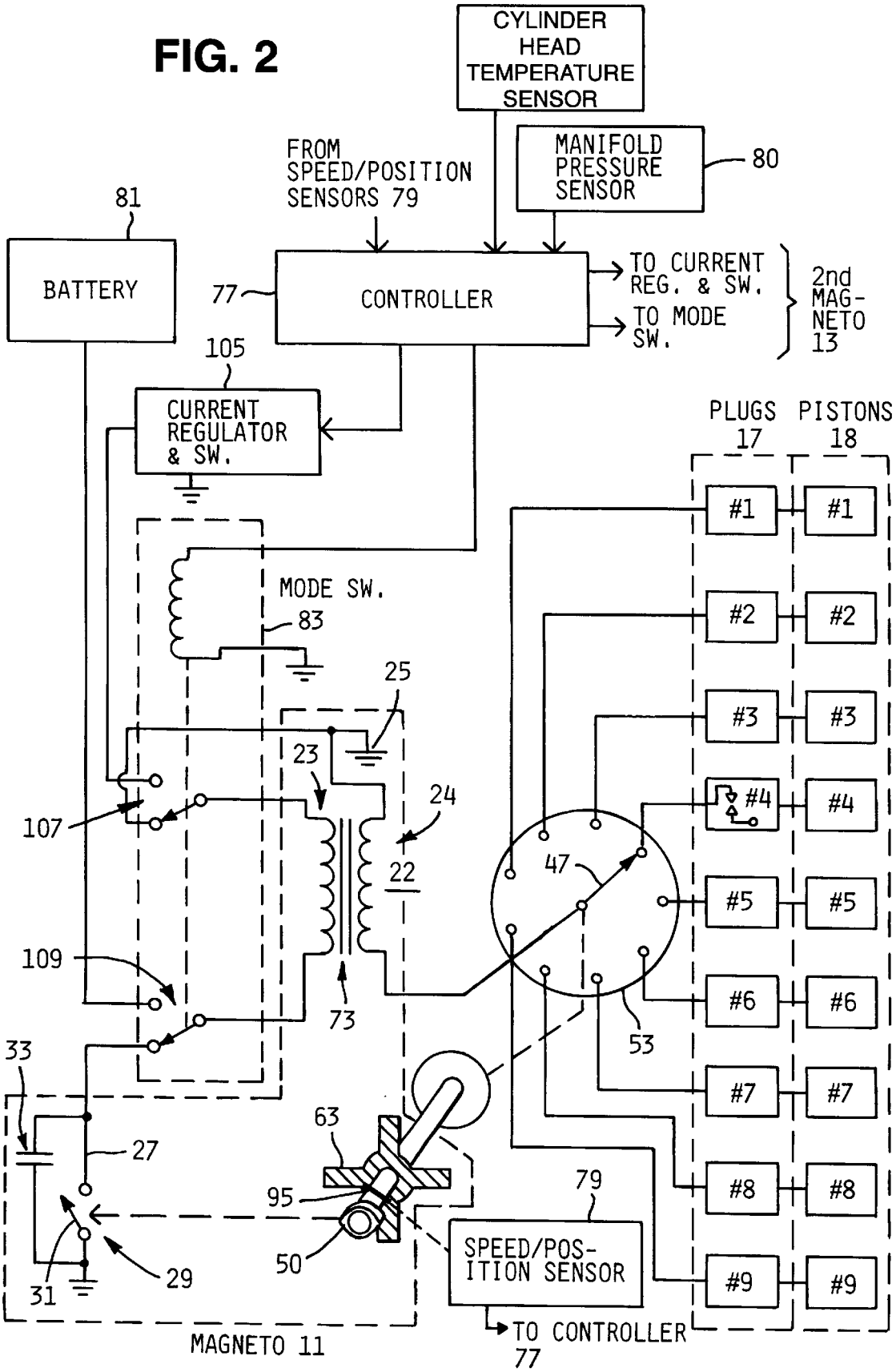
FIG. 2 is a schematic electrical diagram of the magneto-based ignition system pictured in FIG. 1.

Referring to FIG. 2, the magneto 11 of FIG. 1 operates in two alternative spark timing modes. In a first and primary mode, the magneto 11 is adapted to regulate the timing of each spark event at the ignition plugs 17. To control the timing of the spark event, the discharging of the primary coil 23 in the magneto 11 is controlled by a microprocessor-based controller 77. In response to engine condition inputs such as speed/position and manifold pressure sensors 79 and 80, respectively, the controller 77 either advances or retards the spark event relative to a pre-set mechanical setting provided by the conventional mechanical interconnections of the magneto to the engine crankshaft 65.

In accordance with the invention, if one or more selected operating parameters exceed predetermined maximum values, then the controller 77, via the microprocessor 93, initiates an incremental retarding of the optimal spark event advance to bring back the values of the parameters to within a target range. In this illustrated embodiment, the temperature of the engine at its hottest part is measured by a sensor 82. Specifically, the sensor 82 senses the temperature of the cylinder head of the engine and communicates that temperature to the controller 77. As explained more fully hereinafter, the controller responds to the temperature of the cylinder head by trimming or incrementally retarding the timing advance of the ignition events in order to maintain the value of the temperature within a targeted range.

A relay 83 in the schematic diagram of FIG. 2 functions as a mode switch to alternatively switch the ignition system between its primary mode that controls the advance of the ignition timing and a "default" or "fail-safe" mode that provides for operation of the magneto in a conventional manner if the electrical system fails. In this latter mode, the advance of the spark event is set at a fixed advance angle determined by the mechanical linkage between the rotating magnet 63 of the magneto 11 and the crankshaft 65 of the engine 67 as described in connection with the magneto of FIG. 1. Those skilled in the art of electronic design will appreciate that a solid-state switch could replace the relay 83.

As illustrated by the schematic diagram of FIG. 2, when the mode switch 83 is in the position shown in the drawing, the points 27 and 31 of the magneto 11 function to control the discharging of the primary coil 23. Because the timing of the opening and closing of the magneto points 27 and 31 is controlled by the crankshaft 65 as illustrated in FIG. 1, the timing or advance of the spark is fixed.

FIGS. 3A–3C are exemplary timing diagrams illustrating the relative timing of the distributor finger 47, "top-dead-center" of the piston and the spark event at one of the plugs associated with the piston. The diagram of FIG. 3A illustrates the switching window of the distributor finger 47 at each one of the terminals 51 of the distributor head 53. This switching window is a time period in which the spark event must occur. The dashed line passing through all three of the timing diagrams of FIGS. 3A–3C is the top-dead-center (TDC) position of the piston stroke. In its mechanical or "default" mode, the ignition system of the engine 67 is fixed at a static advance angle with respect to the TDC position of the piston as illustrated in FIG. 3B. In its electronic mode, the controller 77 controls the timing of the discharging of the primary coil 23. With respect to the TDC position of the piston, the spark event can be advanced over a wide range. As FIG. 4 illustrates, the timing can be advanced in the electronic mode without sacrificing the total spark energy as would occur in a conventional magneto.

Figure 8:
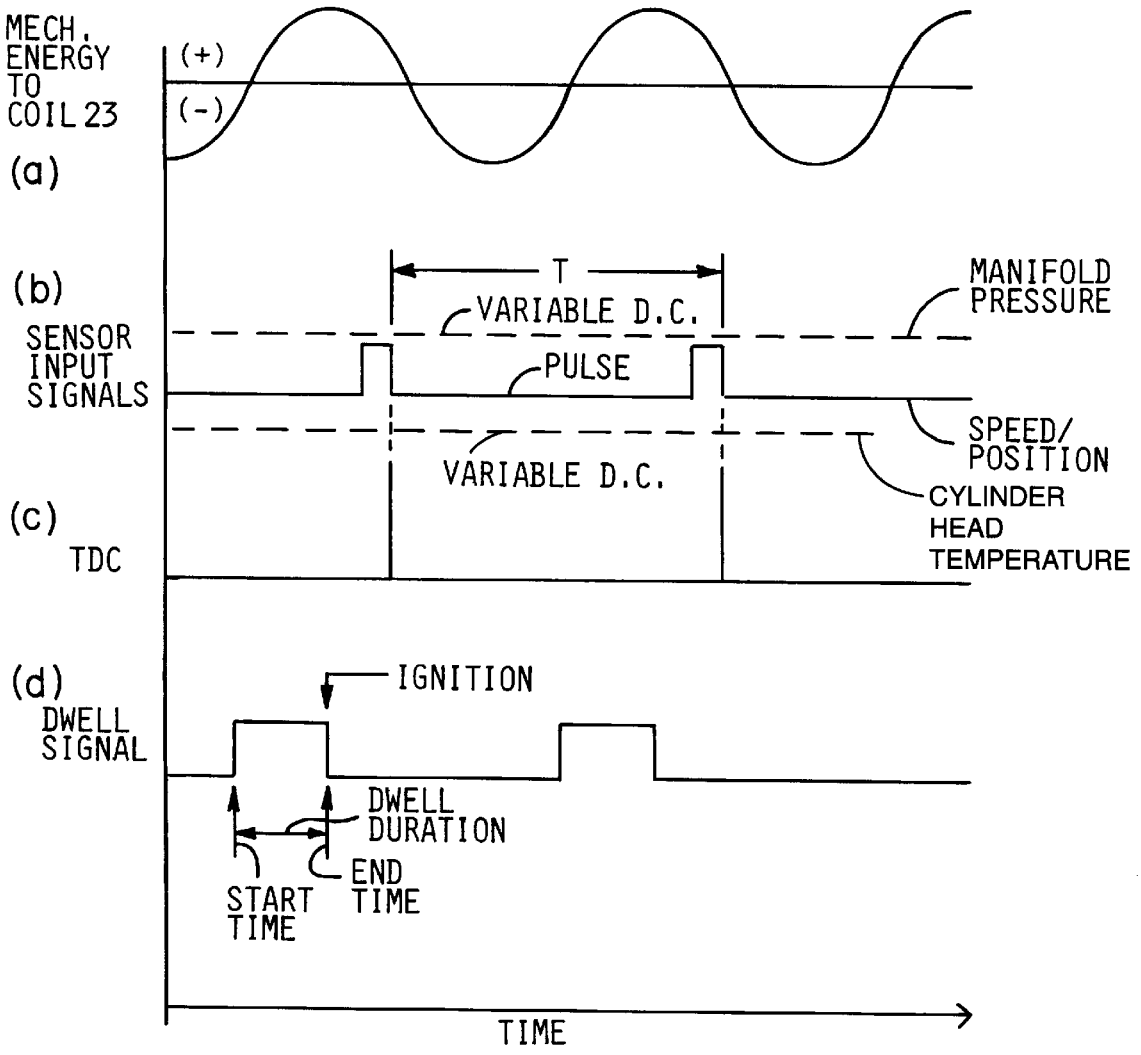
FIG. 8 is a timing diagram including exemplary and idealized waveforms (a) through (d), which illustrate various waveforms and timing parameters of the ignition system.

The important timing parameters of the ignition system according to the invention can be appreciated with reference to the exemplary and idealized waveforms in FIG. 8. Waveform (a) is a representation of the voltage appearing across the primary coil 23 in response to the changing magnetic field of the rotating magnet 63. The energy imparted to the primary coil 23 by the battery 81 complements the energy imparted to the coil by the rotating magnet 63 only during the positive portions of the oscillating energy cycle of waveform (a). The number of poles of the magnet 63 is selected in the illustrated embodiment so that the top-dead-center positions for each of the pistons 18 of the engine 67, as illustrated in waveform (c) of FIG. 8, are synchronized with the positive portions of the energy cycle of waveform (a). In effect, the invention doubles the number of poles on the rotating magnet 63 (relative to a conventional magneto) in order to double the frequency of the signal of waveform (a) in FIG. 8.

Waveform (b) of FIG. 8 illustrates the three signals derived from the speed/position, manifold pressure, and cylinder head temperature (CHT) sensors 79, 80, and 82, respectively. Each of the manifold pressure and CHT sensors 80 and 82, respectively, provides a variable DC voltage that is periodically sampled by the controller 77. The speed/position sensor 79 is read by the digital inputs 97 in a conventional manner and converted to speed information by deriving the value of the period T between successive pulses—i.e., the speed is inversely proportional to the period T.

After the controller 77 samples the value of the signals from the sensors 79, 80 and 82, updated values for the start and end times of the dwell signal are calculated as described hereinafter. In waveform (d) of FIG. 8, the dwell signal is illustrated as a square wave with the falling edge of the square wave corresponding to the "end time," which determines the value of the advance angle for the spark event. The start time of the dwell signal is determined by the controller 77 to ensure that the energy in the coil 23 at the end time is at the value determined by the look-up table 117.

When the controller 77 of FIG. 2 energizes the mode switch 83, the relay action of the switch disconnects the primary coil 23 from the points 27 and 31 on one end and ground on the other and connects the primary coil to the controller 77 as illustrated. One end of the primary coil 23 is connected to the battery 81 of the electrical system at relay switch 109. The other end of the primary coil 23 is connected to ground through a current regulator and switch 105. The mode switch 83 is mechanically biased in the position illustrated in FIG. 2 so that a loss of power from the electrical system de-energizes the relay of the mode switch, thereby defaulting the ignition system to a conventional magneto configuration.

By controlling the current through the primary coil 23, the controller 77 controls the total energy delivered to each of the plugs 17 for each spark event. By controlling the total energy and timing of the spark event, the controller 77 provides for increased efficiency of the engine 67 by advancing or retarding the spark in accordance with changing engine parameters such as, cylinder head temperature (CHT), speed/position, and manifold pressure as indicated in the illustrated embodiment.

As best illustrated in FIG. 2, the speed/position sensor 79 is preferably a Hall effect device mounted proximate to a rotating blade 95 on the drive shaft 61. Rotation of the blade 95 with the drive shaft 61 induces a periodic signal in the speed/position sensor 79 whose frequency is linearly proportional to the speed (rpm) of the engine 67. The instantaneous phase of the periodic signal is proportional to the instantaneous position of each piston 18 in its reciprocating stroke (see the waveforms of FIG. 8). As explained more fully hereinafter, this frequency and phase information is used by the controller 77 to control the frequency and absolute timing of the spark events so that each event occurs at the desired advance/retard angle with respect to the "top-dead-center" position of the associated piston 18.

Figure 5:
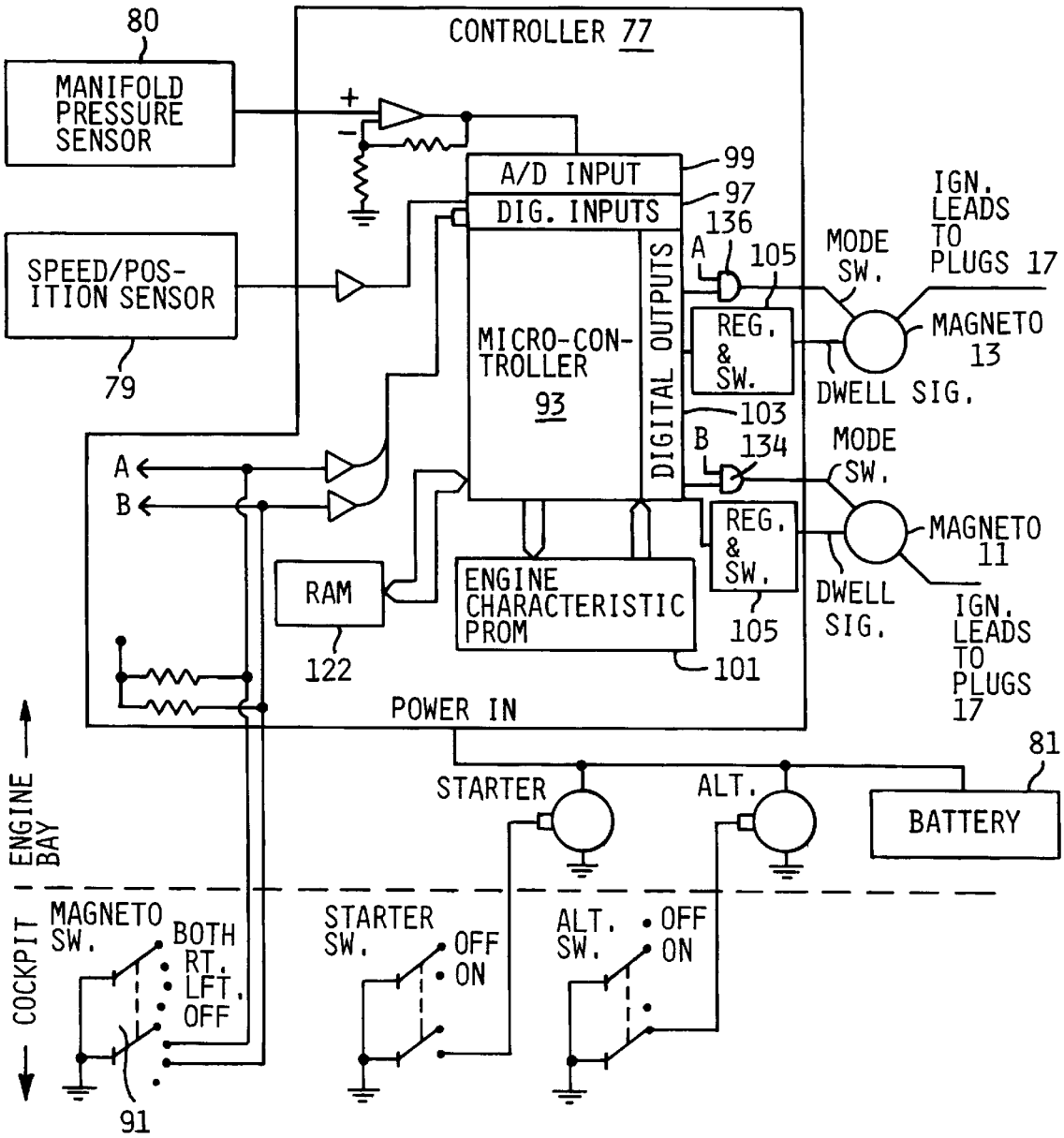
FIG. 5 is a functional schematic diagram of the electronic controller and sensor inputs to it that provide a status of engine parameters in response to which the controller advances or retards the timing of the spark event.

As illustrated in FIG. 5, the controller 77 includes a microcontroller or microprocessor 93. Preferably, the microprocessor 93 is of the 87C196 series manufactured by Intel Corporation of Santa Clara, Calif. The microcontroller 93 employs a down-counter (not shown) that counts down from the falling edge of the signal from the speed/position sensor 79 for the purpose of determining the timing of a "dwell" signal for delivering energy to the primary coil 23 of each of the magnetos 11 and 13. In this connection, from the signal from the speed/position sensor 79, the microcontroller 93 identifies $\Delta\Theta$/seconds, which allows the microcontroller to load the counter with an appropriate value, which is counted down to zero in order to demark the selected advance time for the ignition event. From the time period of dwell signal selected from a look-up table 117 described hereinafter, the microcontroller 93 identifies a time prior to the ignition event to start energizing the primary coil 23 so that it contains the appropriate amount of energy when the time of the discharge event occurs. As described hereinafter, the "stop" time of the dwell signal corresponds to the time of the ignition event and the "start" time of the dwell signal corresponds to the lead signal time required to adequately charge the primary coil 23 to a desired energy level prior to the ignition event.

The signal from the speed/position sensor 79 is delivered to a digital input 97 for the microcontroller 93 as illustrated in FIG. 5. Analog signals from the manifold pressure and the cylinder-head temperature sensors 80 and 82, respectively, are delivered to an analog-to-digital (A/D) converter 99, where the signals are converted to digital information for processing by the microcontroller 93. Preferably, the manifold and temperature sensors 80 and 82, respectively, are Motorola P/N MPX5100AP and Watlow-Gordon P/N S10D/PM4C/036J. Other well know sensors (not shown) may also be employed on keeping with the invention for the purpose of measuring an operating parameter of the engine 67 and controlling its values by adjusting the timing advance provided by the ignition system. Examples of other types of sensors that may be employed in keeping with the invention include exhaust gas temperature, turbine inlet temperature, oil temperature, and others (e.g., pressure sensors). Those skilled in the art will appreciate that some measured parameters may be both controlled to be maintained within a targeted range of values and used to determine the optimum spark advance. Other measured parameters may be used for only one of these two function. The particular arrangement employed depends on the operating conditions mandated for the engine 67.

In keeping with the invention, the engine status information derived from the sensors 79 and 80 is used by the microcontroller 93 under its program control to identify timing and energy information for each spark event. In the schematic diagram of FIG. 5, an engine characteristic PROM 101 includes the look-up table 117 (see FIG. 9) of timing and energy information for a spark event. The engine parameter information derived from the sensors 79 and 80 is used by the microcontroller 93 to identify specific timing and energy information in the look-up table 117, which is converted to a dwell signal for a spark event. The timing and energy information is outputted via digital outputs 103 as illustrated in FIG. 5 to each of the current regulators and switches 105. This data is delivered to the current regulator and switch 105 and converted to a dwell signal for controlling the energization level of the primary coil 23 and the timing of its discharging as discussed more fully hereinafter.

Figure 11:
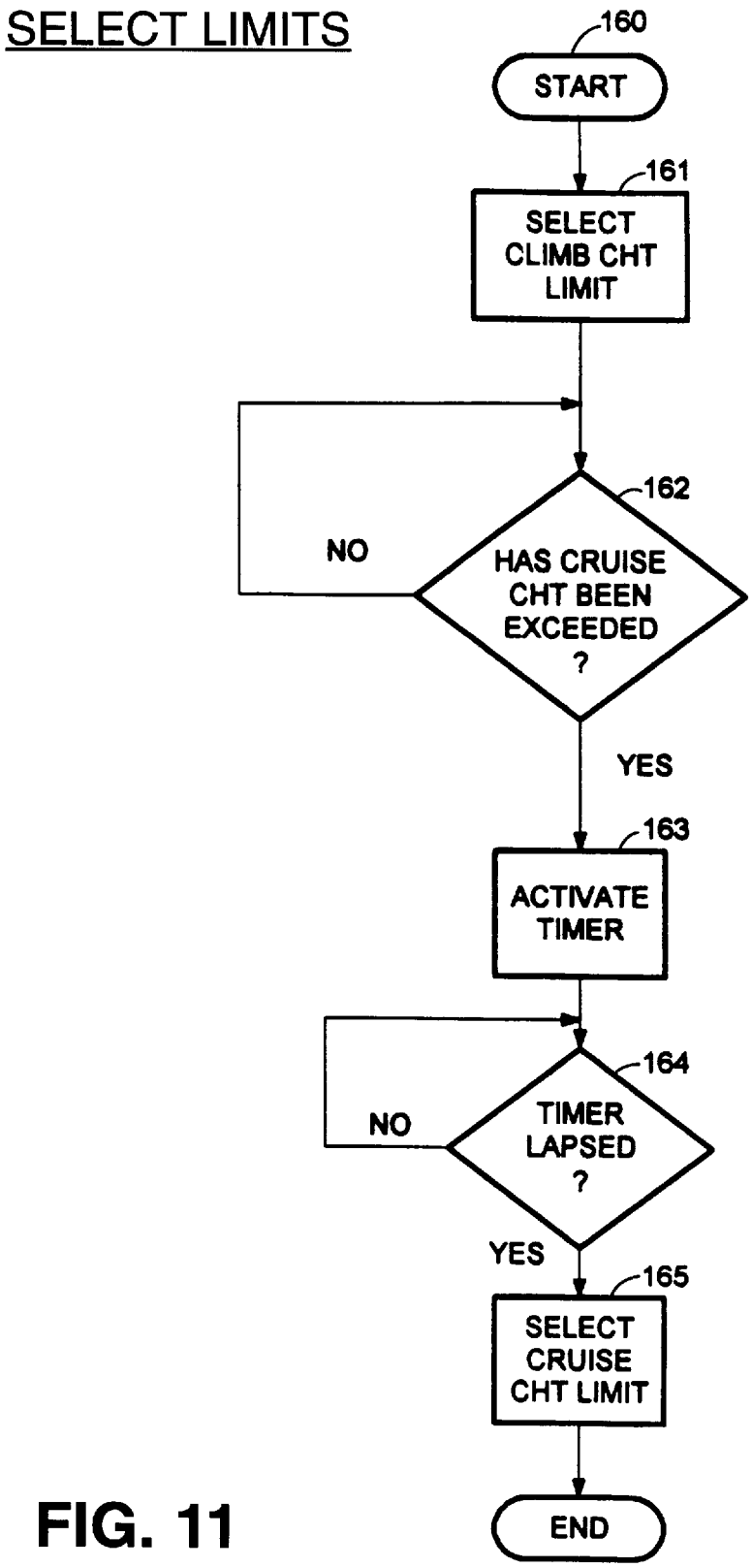
FIG. 11 is a flow diagram illustrating the steps executed by the micro-controller of FIG. 11 in order to select a maximum value for a temperature of the cylinder head of the engine, which when reached triggers a trimming of the ignition timing advance in accordance with the invention.

If the temperature of the cylinder head exceeds a predetermined maximum operating limit, however, the microcontroller 93 incrementally retards the timing of the spark events until the temperature is drawn below the maximum value. To ensure the engine maintains sufficient power for safe operation, the maximum operating limit varies depending on the operating condition of the aircraft. The minimum timing advance for safe operation is also pre-programmed into the system, below which the controller cannot retard the ignition timing. In the illustrated and preferred embodiment, there are two alternative maximum limits for the cylinder head temperature—i.e., cruise (or lower) limit and climb (or higher) limit. FIG. 11 represents the steps the microcontroller 93 executes to select the appropriate maximum value. When the engine is first started at step 160, the microcontroller selects the "climb" maximum limit at step 161, which is the higher of the two maximum limits. If in the course of the engine's operation the cylinder head temperature does not exceed the lower or "cruise" maximum limit, the microprocessor maintains its selection of the higher "climb" maximum limit. At step 162, the microcontroller detects whether the cylinder head temperature has exceeded the "cruise" maximum limit. Once the "cruise" maximum limit is exceeded, the microcontroller activates a timer at step 163, and the timer begins to count down a predetermined amount of time. In the illustrated and preferred embodiment, the predetermined amount of time is sixteen (16) minutes. At step 164, the microcontroller monitors the timer until the predetermine amount of time has elapsed. Once the predetermine amount of time has elapsed, the microcontroller selects at step 165 the "cruise" maximum limit as the temperature limit above which the timing of the spark event is retarded.

The aircraft requires more power during takeoff than while it is at cruising altitude. By providing the dual temperature limits and the delayed transition to the lower of the two limits, the engine 67 is allowed to initially reach more extreme operating conditions before its power is trimmed by an incremental retarding of the ignition advance. This feature is important during takeoff of the aircraft because the high power demands placed on the engine during takeoff are more likely to temporarily drive an operating parameter to an extreme value. The higher "climb" value allows the engine 67 to reach a higher value of the operating parameter before beginning an incremental retarding of the ignition advance. The "climb" value is selected when the engine is first started. For long term operation of the engine, however, the lower "cruise" value is the desired maximum value. In order to provide this lower value as the long term value while allowing a higher value during takeoff, the controller 77 maintains the "climb" value until the lower "cruise" value is exceeded. The controller then selects the lower "cruise" value for the remainder of the engine's operation as the temperature above which retarding begins, but only after the predetermined time period has elapsed. The delay in transitioning from the high value to the low value ensures the controller 77 is unlikely to substantially retard the advance of the ignition timing during aircraft takeoff, which could otherwise trim power at a critical time.

Figure 10:
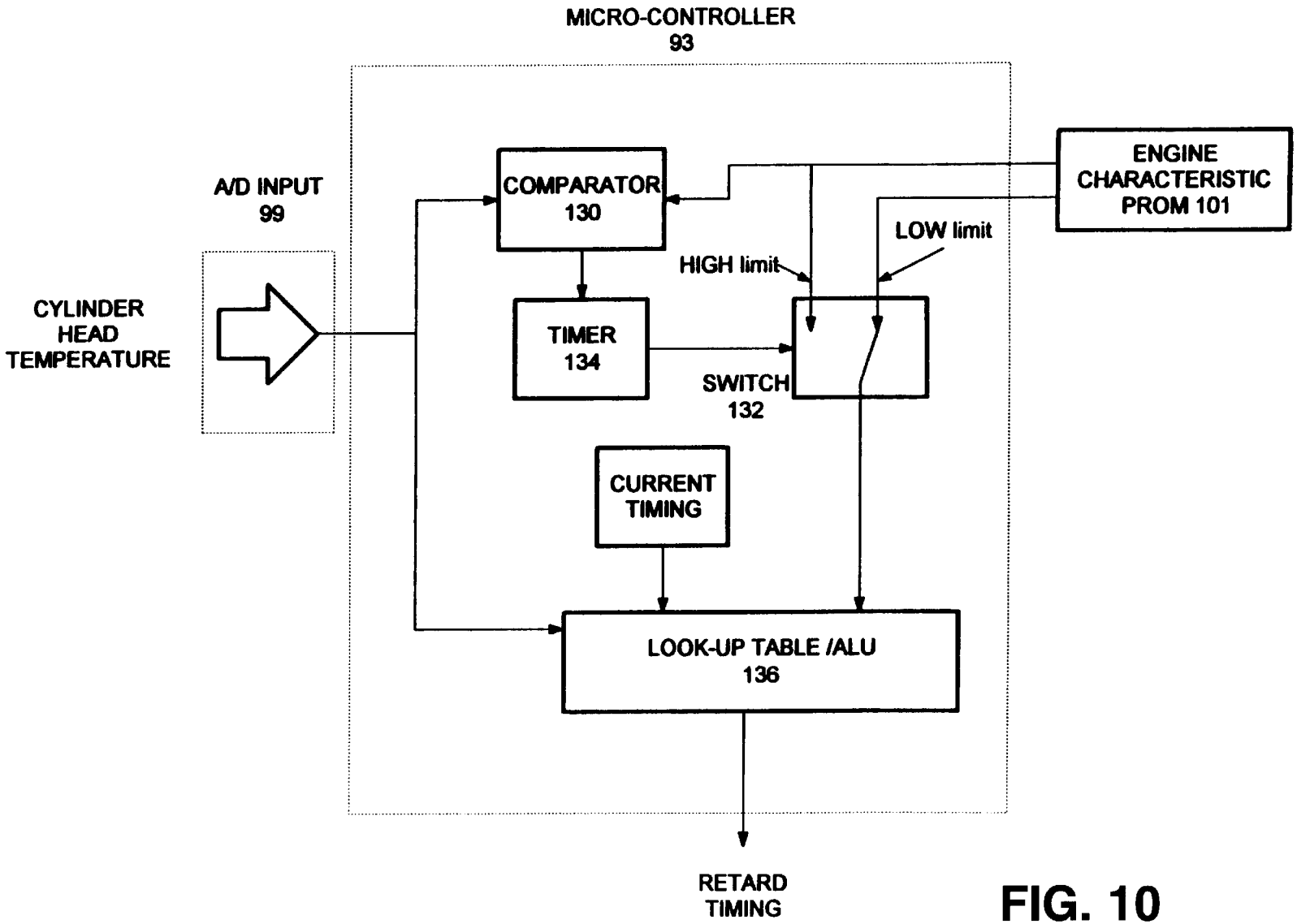
FIG. 10 is a schematic diagram illustrating the functional components of a micro-controller comprising the electronic controller of FIG. 5 in accordance with the invention.

FIG. 10 is a schematic block diagram of the operation of the microcontroller 93 with respect to selecting the cruise or climb maximum cylinder head temperature (CHT) value and advancing or retarding engine timing depending on whether the selected CHT value has been exceeded. The Engine Characteristic PROM 101 contains the relevant characteristic data of the engine, including the cruise and climb maximum CHT values. When the engine is first started, the switch 132 is defaulted to the climb maximum CHT value. At that point, the comparator 130 continuously compares the actual CHT, which is inputted via the A/D input 99, to the cruise CHT value. Once the actual CHT exceeds the maximum cruise CHT value, the comparator signals the timer 134 to begin counting down a predetermined amount of time. When the timer 134 has counted down the predetermined amount of time, the switch 132 selects the cruise CHT value as the maximum CHT value.

The microcontroller 93 uses the actual CHT, the current timing advance, and the maximum CHT value to determine whether the advance needs to be incrementally retarded and the amount of the retard increment. Initially, the value of the current timing advance is the optimal spark event advance based on engine performance parameters such as engine speed/position and manifold pressure, and is obtained from look-up table 117. This "current timing" is then delivered to a look-up table 136, which with the actual CHT and the CHT maximum value determine the amount of retard timing, if any. The retard times stored in the look-up table 136 are based on the following equations:

$$\Delta\text{RETARD TIMING}=(\text{CHT TEMP}-\text{MAXIMUM CHT LIMIT})\times(\text{CURRENT TIMING}-\text{BASE TIMING})/10 \quad (1)$$

$$\text{NEW TIMING}=\text{LOOK-UP TABLE VALUE}-\Delta\text{RETARD TIMING} \quad (2)$$

CHT CONTROL LIMIT: MINIMUM=BASE TIMING

APPLIES ONLY WHEN CHT>MAXIMUM CHT VALUE where CHT TEMP is the present temperature of the cylinder head, MAXIMUM CHT LIMIT is the "cruise" or "climb" maximum CHT limit for the temperature, and (CURRENT TIMING−BASE TIMING) is the present advance angle for the ignition event with respect to the mechanical advance set by the magneto 11 or 13 (i.e., the "BASE TIMING"). As will be apparent to those skilled in the relevant art, an alternative to the look-up table 136 for determining the amount of the retard is appropriate software in the form of executable code for the microcontroller 93, which may use its Arithmetic Logic Unit (ALU) to calculate the amount of retard timing. This approach eliminates the need to store values for the amount of the retard.

Figure 6:
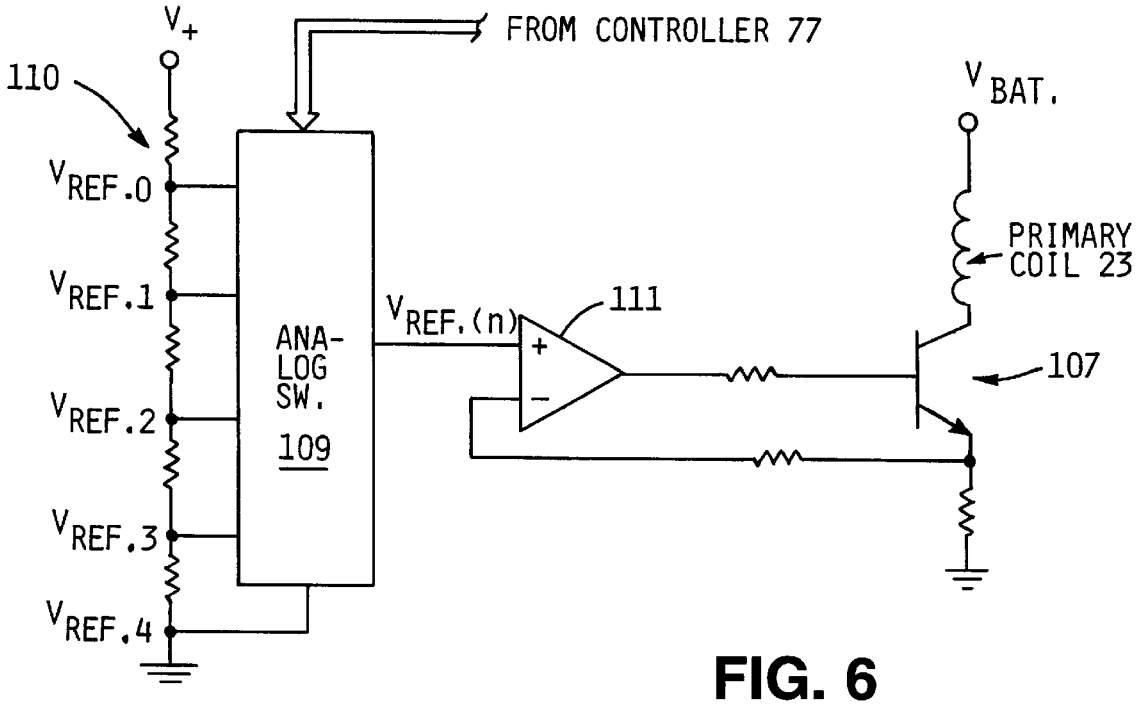
FIG. 6 is a functional block diagram of a current regulator and switch for advancing/retarding the spark event, as well as controlling the total energy of the spark.

Referring to FIG. 6, the current regulator and switch 105 includes an analog switch 109 that is responsive to the controller 77 for selecting one of several reference voltages $V_{REF(n)}$ from a resistor ladder 110 to be output to an operational amplifier 111. The operational amplifier 111 provides the dwell signal, which drives the base of the power transistor 107. In response to the dwell signal, the power transistor 107 operates in its linear region in order to control the maximum current through the primary coil 23. Specifically, the operational amplifier 111 controls the base drive current to the power transistor 107 to maintain the voltage at the emitter of the power transistor 107 at the reference voltage $V_{REF(n)}$ selected by the controller 77. To discharge the energy from the primary coil 23, the power transistor 107 is turned off at the end time of the dwell signal, which causes an open circuit condition to discharge the energy stored in the primary coil 23 through the secondary coil 24 and into the plugs 17 by way of the distributor finger 47. To turn off the power transistor 107 at the end time of the dwell signal, the controller 77 selects the reference voltage $V_{REF(4)}$ which grounds the positive input of the operational amplifier 111. In turn, the power transistor 107 is turned off because the operational amplifier 111 no longer provides a base drive current to the transistor.

Figure 7:
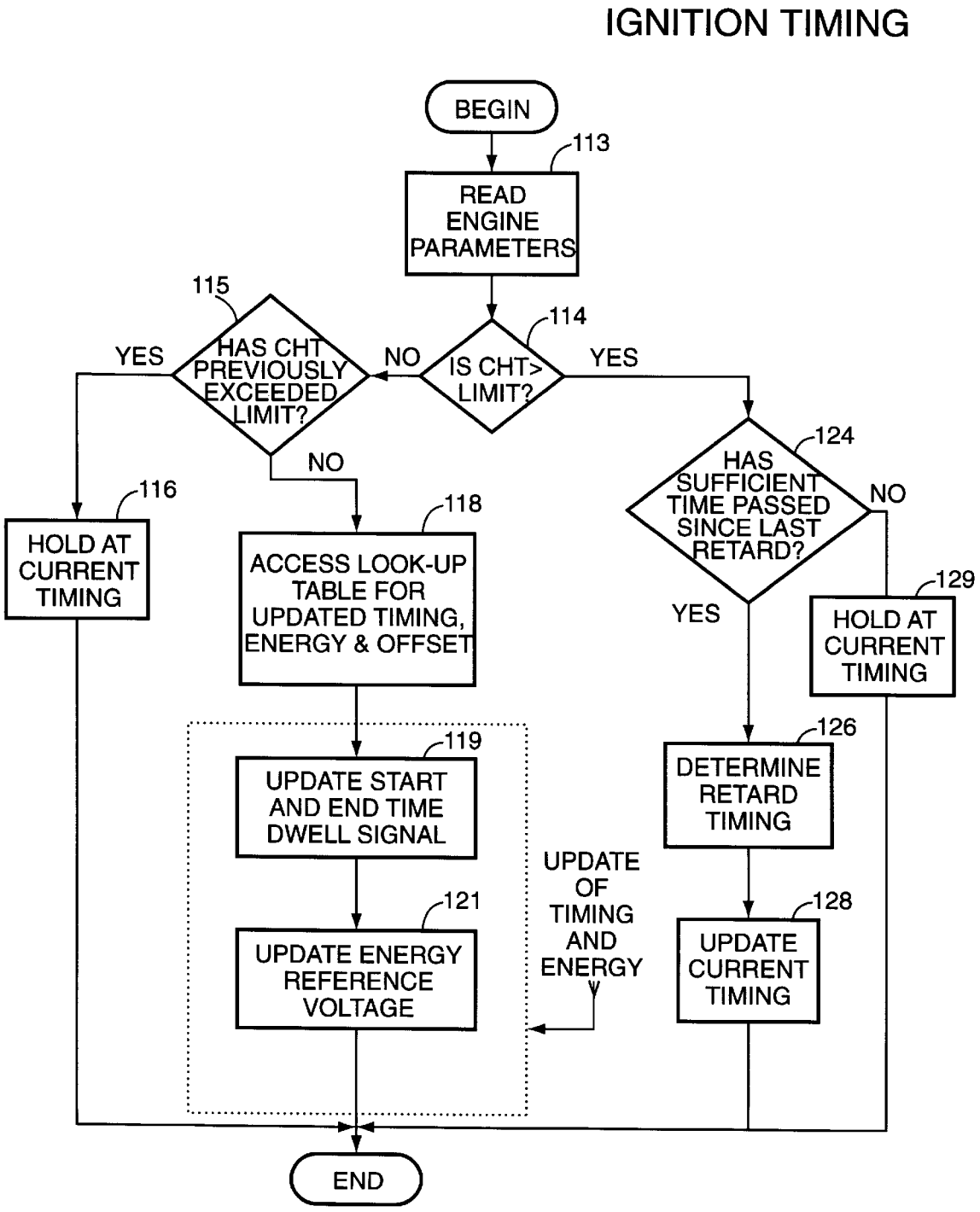
FIG. 7 is a flow diagram illustrating the steps executed by the electronic controller of FIG. 5 in order to update the timing and energy level of the spark event in accordance with the invention.

Approximately every one millisecond, the microcontroller 93 executes the steps illustrated in FIG. 7 to update the timing and energy of the spark event for each of the magnetos 11 and 13. At step 113, the microcontroller 93 reads the speed of the engine as derived from the speed/position sensor 79 by way of the digital inputs 97 and also reads the manifold pressure sensor 80 at the A/D input 99. At step 114, the microcontroller 93 determines whether the actual CHT exceeds the maximum CHT value selected by the microcontroller 93. If the CHT does not exceed the maximum CHT value, the microcontroller 93 branches to step 115 and determines whether the CHT has previously exceeded the maximum CHT value. If the CHT maximum has been previously exceeded, the microcontroller 93 branches to step 116, where it holds the advance of the timing at the current value. In this way, the microcontroller 93 avoids advancing the timing of the spark event into a region that has previously caused the temperature of the engine to exceed the maximum value.

If at step 115 the microcontroller 93 determines that the CHT has not previously exceeded the maximum CHT value, then at step 118 the microcontroller 93 accesses the look-up table 117 (see FIG. 10), which translates the values of the engine speed/position and the manifold pressure into start and end times for the dwell signal to the primary coil 23 and a total energy level for the spark event (i.e., $V_{ref(n)}$ of the analog switch 107). At steps 119 and 121, the microcontroller 93 stores the updated dwell signal and energy value for the spark event in an appropriate register or a memory location such as a RAM 122 (see FIG. 5).

If the microcontroller 93 determines at step 114 that the CHT is greater than the maximum CHT value, the microcontroller branches to step 124 and determines whether sufficient time has passed since the last time the advance of the timing was retarded. If this is the first time the CHT has exceeded the maximum value, step 124 assumes sufficient time has passed. If the microcontroller determines at step 124 that sufficient time has passed since the last adjustment of the timing advance, the microcontroller 93 then looks up or calculates the retard timing (as described earlier) at step 126 and updates the current timing (i.e., trims the spark event advance by the amount of the retard) at step 128. The time period in step 124 provides a minimum time period between successive adjustments of the ignition timing, during which the temperature of the engine has sufficient time to react to the previous retarding of the ignition timing before the timing is further retarded. If at step 124 sufficient time has not elapsed since the last retard, the microcontroller 93 will, at step 129, maintain the current timing.

After the steps in FIG. 7 are executed, the microcontroller 93 returns to other tasks or background operation until the remaining portion of the one millisecond allocation is complete, at which time the steps of FIG. 7 are executed again.

Figure 9:
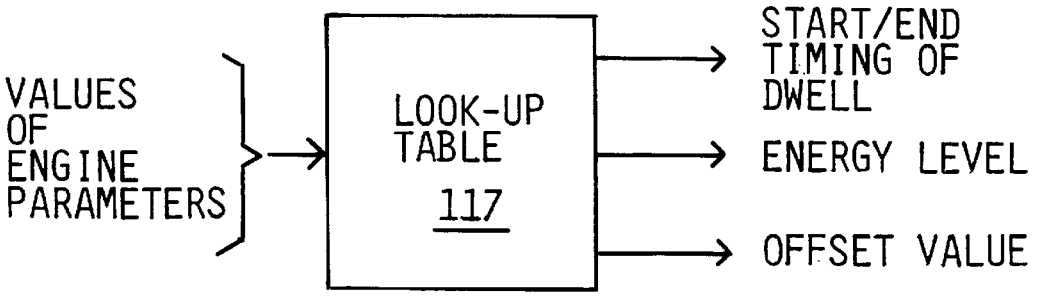
FIG. 9 is a schematic diagram of a look-up table of the electronic controller for converting values of engine operating parameters into ignition timing and energy level commands for delivery to the current regulator and switch of FIG. 6.

Referring to FIG. 9, the precise makeup of the look-up table 117 is dependent upon empirical data gathered for the engine 67. For example, the empirical data may be collected using the following approach. First, performance criteria are selected. In one example, a single criterion of maximum torque is selected. Given the selected criteria or criterion, controllable parameters of the engine 67 are varied over the expected operating range of the engine in order to determine the approximate functional relationship between the controllable parameters and the selected criteria or criterion that is to be optimized. Depending on the complexity of this functional relationship, the amount of empirical data to be gathered is determined. Specifically, if the functional relationship is somewhat linear, the number of data points stored in the look-up table 117 can be less than if the functional relationship is substantially non-linear and wide ranging.

Once the number of data points has been established, each of the engine parameters is varied in incremental steps while the others are held constant. At each setting of the parameters, the ignition advance angle, magneto coil energy and relative timing of the two magnetos 11 and 13 are adjusted in order to determine optimum performance of the engine 67 with respect to the selected criteria or criterion.

The values for the advance angle, total magneto coil energy and relative timing of the two magnetos are placed into the look-up table 117. For example, for the illustrated embodiment the controllable parameters of the engine 67 used by the look-up table 117 are the engine speed/position and the manifold pressure. In order to fill the look-up table 117, one of these parameters (i.e., engine speed/position or manifold pressure) is varied while the other is held constant. The parameter is varied in incremental steps over its operating range, where the size of the incremental steps is determined by the complexity of the relationship between the variable and the criteria or criterion which is to be optimized. With a sufficient number of data points entered into the look-up table 117, a simple linear interpolation algorithm can be used to derive the appropriate advance angle, total energy and relative timing data for all values of the signals from the speed/position sensor 79 and the manifold pressure sensor 80.

The controller 77 controls not only the current regulator and switch 105 and the mode switch 83 of the magneto 11 as illustrated, but it also controls a similar current regulator and switch 105 and a mode switch (not shown) of the second magneto 13. Because the hardware architecture of the ignition system of the invention provides for separate control of the two magnetos, the timing of the ignition event at each of the two plugs associated with a piston can be adjusted with respect to one another.

The controller 77 coordinates the timing advance of the spark event for each of the two plugs associated with a common piston by electronically controlling the timing in each of the two magnetos 11 and 13 as illustrated. By staggering the initiation of the spark events for the two plugs of a piston, the duration of the total spark event can be effectively extended, thus providing an additional ability to control combustion of fuel in order to optimize performance of the engine 67. The precise nature of the staggering to extend the spark event and the engine conditions under which such staggering aids performance must be empirically determined. In keeping with the invention, however, the retarding of the ignition event in order to draw down the temperature of the engine may include a function in which the staggering of the ignitions is adjusted.

From the foregoing it can be seen that the ignition system illustrated in FIGS. 1–11 provides an ignition system that dynamically adjusts the timing and energy of the spark events in order to ensure that the engine 67 operates at close to optimum performance without exceeding predetermined operating conditions. Using various sensors such as the cylinder head temperature sensor 82, the speed/position sensor 79 and the manifold pressure sensor 80, which provide information indicative of the operating status of the engine 67, the engine's performance is tailored to ensure its operation is optimized within a range of acceptable values for selected operating parameters. In this connection, those skilled in the art of ignition systems and engines for aircraft will appreciate that the precise response characteristics of the ignition system to changes in the values of various parameters sensed by any embodiment of the ignition system according to the invention will be at least partially dependent on the particular characteristics of the engine and, therefore, may be dependent upon a database of empirically gathered information regarding the operating characteristics of the engine.

We claim:

1. A magneto-based variable ignition timing system for an internal combustion engine comprising: a sensor for sensing values of an operating parameter; a memory for storing a limit for the values of the operating parameter and a base timing from which the ignition timer cannot further retard the timing of the ignition event; an ignition timer in communication with the sensor for dynamically adjusting a timing of a spark event, whose source of energy includes the magneto; and, the timer including means responsive to the memory and the values of the operating parameter for limiting the advancing of the dynamic timing of the spark event in order to inhibit the values of the operating parameter from crossing its associated limit value.

2. The magneto-based variable ignition timing system of claim 1 wherein the memory includes at least two limits for the operating parameter.

3. The magneto-based variable ignition timing system of claim 1 wherein the operating parameter is a temperature of the engine.

4. The magneto-based variable ignition timing system of claim 2 including a switch in communication with the memory for first selecting one of the at least two limits.

5. The magneto-based variable ignition timing system of claim 4 including a detector in communication with the sensor for controlling the switch to select a second one of the limits when the value of the parameter is beyond a limit.

6. The magneto-based variable ignition timing system of claim 5 including a timer for delaying the selection of the second one of the limits for a predetermined time period.

7. The magneto-based variable ignition timing system of claim 3 wherein the engine temperature is a cylinder head temperature.

8. The magneto-based variable ignition timing system of claim 1 wherein the magneto has a fixed mechanical timing that is minimum advance setting for the timing of the event.

9. The magneto-based variable ignition timing system of claim 8 including a failure mechanism wherein failure of the ignition timer results in the timing of the ignition event to be controlled by the mechanical timing of the magneto.

10. The magneto-based variable ignition timing system of claim 1 wherein energy for the ignition event is supplied by the magneto and a battery.

11. The magneto-based variable ignition timing of claim 1 further comprising a mode switch for normally selecting the ignition timer for controlling the timing of the ignition event and alternatively for selecting a breaker mechanically responsive to the position and speed of the internal combustion engine for controlling the timing of the ignition event when there is a failure of the ignition timer.

12. A method of regulating a temperature of an internal combustion engine, the method comprising the steps of: dynamically controlling timing of ignition events in response to performance parameters of the engine in order to maintain a timing of the events that results in an efficient operation of the engine; sensing a temperature of the engine; and retarding the timing of the ignition events from the timing resulting in efficient operation of the engine when the temperature of the engine exceeds a limit such that the temperature of the engine is drawn down to a temperature at or below the limit, wherein the limit has higher and lower values of which only one is compared to the temperature of the internal combustion engine at any given time.

13. The method of claim 12 including the step of setting a base timing from which there can be no further retarding of the timing of the ignition events.

14. The method of claim 13 wherein the base timing is the same as a mechanical timing of the ignition events provided by a magneto.

15. The method of claim 12 wherein the step of sensing the temperature of the engine includes sensing a temperature of a cylinder head of the engine.

16. The method of claim 12 wherein the higher value of the temperature limit is employed initially after the engine is started.

17. The method of claim 16 wherein the lower value of the temperature limit is employed after the temperature of the engine has exceeded the lower limit for a finite period of time.

18. The method of claim 17 wherein the finite period of time is a fixed period of time.

19. The method of claim 12 including the step of drawing energy for the ignition event from a magneto.

20. The method of claim 19 including the step of substituting a fixed mechanical timing for the dynamic timing of the ignition events upon failure of an electrical system that controls the dynamic timing.

21. The method of claim 12 wherein the performance parameters include engine speed.

22. The method of claim 20 wherein the performance parameters include pressure of a manifold of the engine.

23. A magneto-based variable ignition timing system for an internal combustion engine comprising: a sensor for sensing values of an operating parameter of the engine; a memory for storing at least two limits for the values of the operating parameter; an ignition timer in communication with the sensor for dynamically adjusting a timing of a spark event, whose source of energy includes the magneto; and, the timer including means responsive to the memory and the values of the operating parameter for limiting the advancing of the dynamic timing of the spark event in order to inhibit the values of the operating parameter from crossing its associated limit value.

24. The magneto-based variable ignition timing system of claim 23 wherein the operating parameter is a temperature of the engine.

25. The magneto-based variable ignition timing system of claim 23 including a switch in communication with the memory for first selecting one of the at least two limits.

26. The magneto-based variable ignition timing system of claim 25 including a detector in communication with the sensor for controlling the switch to select a second one of the limits when the value of the engine parameter is beyond a limit.

27. The magneto-based variable ignition timing system of claim 26 including a timer for delaying the selection of the second one of the limits for a predetermined time period.

28. The magneto-based variable ignition timing system of claim 24 wherein the engine temperature is a cylinder head temperature.

29. The magneto-based variable ignition timing system of claim 23 wherein the magneto has a fixed mechanical timing that is minimum advance setting for the timing of the event.

30. The magneto-based variable ignition timing system of claim 29 including a failure mechanism wherein failure of the ignition timer results in the timing of the ignition event to be controlled by the mechanical timing of the magneto.

31. The magneto-based variable ignition timing system of claim 23 wherein the memory includes a base timing from which the ignition timer cannot further retard the timing of the ignition event.

32. The magneto-based variable ignition timing system of claim 23 wherein energy for the ignition event is supplied by the magneto and a battery.

33. The magneto-based variable ignition timing of claim 23 further comprising a mode switch for normally selecting the ignition timer for controlling the timing of the ignition event and alternatively for selecting a breaker mechanically responsive to the position and speed of the internal combustion engine for controlling the timing of the ignition event when there is a failure of the ignition timer.

34. A method of regulating a temperature of an internal combustion engine, the method comprising the steps of: dynamically controlling timing of ignition events in response to performance parameters of the engine in order to maintain a timing of the events that results in an efficient operation of the engine; sensing a temperature of the engine; retarding the timing of the ignition events from the timing resulting in efficient operation of the engine when the temperature of the engine exceeds a limit such that the temperature of the engine is drawn down to a temperature at or below the limit, and setting a base timing from which there can be no further retarding of the timing of the ignition events.

35. The method of claim 34 wherein the limit has higher and lower values of which only one is compared to the temperature of the internal combustion engine at any given time.

36. The method of claim 34 wherein the base timing is the same as a mechanical timing of the ignition events provided by a magneto.

37. The method of claim 34 wherein the step of sensing the temperature of the engine includes sensing a temperature of a cylinder head of the engine.

38. The method of claim 35 wherein the higher value of the temperature limit is employed initially after the engine is started.

39. The method of claim 38 wherein the lower value of the temperature limit is employed after the temperature of the engine has exceeded the lower limit for a finite period of time.

40. The method of claim 34 wherein the finite period of time is a fixed period of time.

41. The method of claim 34 including the step of drawing energy for the ignition event from a magneto.

42. The method of claim 41 including the step of substituting a fixed mechanical timing for the dynamic timing of the ignition events upon failure of an electrical system that controls the dynamic timing.

43. The method of claim 34 wherein the performance parameters include engine speed.

44. The method of claim 34 wherein the performance parameters include pressure of a manifold of the engine.

* * * * *